US009408500B2

(12) United States Patent
McFall

(10) Patent No.: US 9,408,500 B2
(45) Date of Patent: Aug. 9, 2016

(54) SHOWER CURTAIN DRYER

(71) Applicant: Marilyn McFall, Katy, TX (US)

(72) Inventor: Marilyn McFall, Katy, TX (US)

( * ) Notice: Subject to any disclaimer, the term of this patent is extended or adjusted under 35 U.S.C. 154(b) by 238 days.

(21) Appl. No.: 14/084,831

(22) Filed: Nov. 20, 2013

(65) Prior Publication Data

US 2015/0135426 A1 May 21, 2015

(51) Int. Cl.
*A47K 3/00* (2006.01)
*A47K 3/38* (2006.01)

(52) U.S. Cl.
CPC ..... *A47K 3/38* (2013.01)

(58) Field of Classification Search
CPC ..... A47K 3/38; A47H 5/09; A47H 19/00
USPC ..... 160/330, 349.2, DIG. 6; 4/608, 610
See application file for complete search history.

(56) References Cited

U.S. PATENT DOCUMENTS 1,047,526 A * 12/1912 Ice ..... E04F 10/10 160/349.2
1,678,703 A * 7/1928 Mueller ..... E03C 1/06 4/610
1,746,269 A * 2/1930 Lupton ..... A47H 21/00 160/128
2,545,648 A * 3/1951 Byrne ..... A47K 3/38 4/558
3,025,969 A * 3/1962 Daley ..... A47K 3/38 211/119.009
3,418,665 A * 12/1968 Long ..... A47K 3/30 160/349.1
5,103,531 A * 4/1992 Perrotta ..... A47K 3/38 16/87 R
5,499,725 A * 3/1996 Palumbo ..... A47K 3/001 211/105.1
5,662,297 A * 9/1997 Christensen ..... A47K 3/38 211/105.1
7,686,062 B1 * 3/2010 Darnell ..... A47H 21/00 160/123
8,621,680 B2 * 1/2014 Maes ..... A47K 3/38 4/610
8,739,324 B2 * 6/2014 Napier ..... A47K 3/38 29/455.1

FOREIGN PATENT DOCUMENTS

DE 3938467 A1 * 5/1991 ..... A47K 3/38
DE 202013102982 U1 * 7/2014 ..... A47K 3/281

* cited by examiner

*Primary Examiner* — Erin Deery
(74) *Attorney, Agent, or Firm* — Ramey & Schwaller, LLP

(57) ABSTRACT

Devices for retaining shower curtains in bath tubs to prevent mildew, fungus, bacteria and mold from growing at the interface of the shower curtain and the bath tub are disclosed. The devices are capable of being installed in existing showers and pull the curtain back from the shower tub.

18 Claims, 2 Drawing Sheets

SHOWER CURTAIN DRYER

FIELD

This invention relates generally to the field of bathroom products used for the prevention of mold and bacteria buildup in and around bathtubs. More specifically, the invention relates to the field of retaining an unused shower curtain such that it is able to dry and not promote the growth of mold, mildew or bacteria.

BACKGROUND

Many homes have showers within bath tubs alternatively called shower tubs consisting of a shower head that directs water on a person who seeks to wash themselves. These showers generally have at least three walls, a ceiling, a tub to contain the shower water or bath water at the bottom of the shower and a shower curtain, preventing water either directly from the shower head or indirectly from the walls or person from wetting areas outside of the shower tub. Even though the primary purpose of the shower head is to apply water to the person's body for wetting before soaping and for rinsing, it is difficult to prevent water from wetting the walls of the shower tub, including the tub itself and the shower curtain.

The shower curtain is typically affixed at a top end by a series of clamps or rings which insert over a shower curtain rod. The curtain hangs downwardly, providing a partition between the shower stall and the rest of the bathroom area. It is common, and recommended, that the shower user tuck the bottom end of the shower curtain inside the tub, thereby avoiding any splashing of water from out of the shower stall.

Due to the fact that the bottom end of the curtain hangs within the tub area, it is common for such bottom end to come in contact with the inner surface of the tub. Further, when water is introduced, the curtain tends to stick to the inner surface of the tub. If the curtain is not completely dried after each use, mold and mildew growth is promoted between the curtain and tub inner surface. Further, due to the effects of gravity, the bottom end of the shower curtain is always the last area of the curtain to dry. Realistically, the shower curtain, and especially the bottom end, is never completely dried after each use of the shower. In fact, it is usually completely saturated. The water that wets the walls, tub and curtain is of concern, because in many situations, accumulated the water causes mold, mildew, fungus, bacteria etc.

In addition, as the water on the shower curtain evaporates, iron, calcium and soap residue can remain on the curtain. This residue makes the shower look dirty, covering the shine of wall materials such as tile, glass, etc.

In fact, during the drying process, any places wherein the wetted portion of the shower curtain touches either the walls of the shower tub, the tub itself or other folds in the shower curtain are potential places for mold, mildew, bacteria and residue build-up.

During subsequent showers, the residue from previous showers leads to additional retention of water on the walls, thereby leading to additional buildup of deposits, until the walls are later cleaned using cleaning fluids that break down the deposits and rinse them away, often requiring the use of a bristle brush to free the deposits from the wall surfaces and bleaching or replacing the shower curtain.

Additional problems with showering is prevention of mold, mildew and bacteria growth from bathing implements such as washcloths, loofa sponges, back brushes, soft scrub bathing sponges and the like. Normally such implements are placed in a wet condition on the wall of the tub, hanging on the shower head or placed on either the shower knobs or the tub faucet to dry. However, in these situations, the wet bathing implement is in contact with a wet surface. Like the shower curtain touching the walls of the shower tub, the inner wall of the tub itself or wetted folds in the shower curtain, the contact between the bathing implements and any wetted surface can be a breeding ground for mold, mildew, and bacteria, which is then applied to the body of the user upon subsequent showering.

It would therefore be beneficial to have a device capable of retracting and moving a wet shower curtain from resting against either the walls of the shower tub, the inside wall of the tub itself or wherein wet shower curtain folds are touching other wet shower curtain folds during the drying process. Such a device would eliminate the need to bleach or change the shower curtain, thus saving time and money. Further, such a device could incorporate hangars for showering implements such that they are able to dry and not grow mold, mildew or bacteria.

SUMMARY

Embodiments of the invention generally pertain to a shower curtain drying device in a shower having a tub type wall or lip that prevents water from leaving the shower and flowing onto the floor outside the shower area.

In certain embodiments of the aforementioned device, the device comprises a plurality of anchors in a ceiling of a shower, the plurality of anchors positioned in a substantially longitudinal position and facing in a proximal direction.

The aforementioned embodiment further comprises at least one anchor to anchor connection, the connection having two ends, positioned proximally to the ceiling and with one end connecting to one anchor and another end connecting to another anchor, the anchor to anchor connection being further positioned between a curtain rod and a back wall of the shower.

The aforementioned embodiment further comprises a plurality of shower curtain retainers operationally connecting the anchors to a shower curtain when attached to the shower curtain, the shower curtain being positioned in the shower by the shower curtain rod.

In this aforementioned embodiment, when the curtain retainers are attached to the shower curtain, the curtain is pulled back from the tub wall so that no part of the curtain touches the tub wall.

In certain embodiments concerning the anchor to anchor connection, the anchor to anchor connection comprises a chain, a rod, a rope, a wire, a string of lights or a combination thereof.

Other embodiments of the invention concern the curtain retainers. In certain embodiments, the curtain retainers comprise, chains. In other embodiments the curtain retainers comprise wire, rope, a movable rod, a string of lights and the like. Further, the curtain retainers are made of stainless steel, galvanized steel, plastic, brass, copper, plastic, cloth or a combination thereof.

In specific embodiments wherein the anchors are contemplated, the anchors can be eye screws. Still further, in certain embodiments, the anchor to anchor connection comprises hooks between the two ends of the anchor to anchor connection, wherein the hooks are able to hang a washcloth or other shower and bathing implements.

In embodiments wherein the device is employed, to retain the curtain, the curtain retainers are attached to the curtain so that it does not contact the wall of the shower. Likewise, no part of the curtain touches another part of the curtain. The exception being a clip location wherein the curtain is pinched in a small area by each clip.

BRIEF DESCRIPTION OF THE DRAWINGS

In order that the manner in which the above-recited and other enhancements and objects of the invention are obtained, we briefly describe a more particular description of the invention briefly rendered by reference to specific embodiments thereof which are illustrated in the appended drawings. Understanding that these drawings depict only typical embodiments of the invention and are therefore not to be considered limiting of its scope, we herein describe the invention with additional specificity and detail through the use of the accompanying drawings in which.

LIST OF REFERENCE NUMERALS

Figure 1:
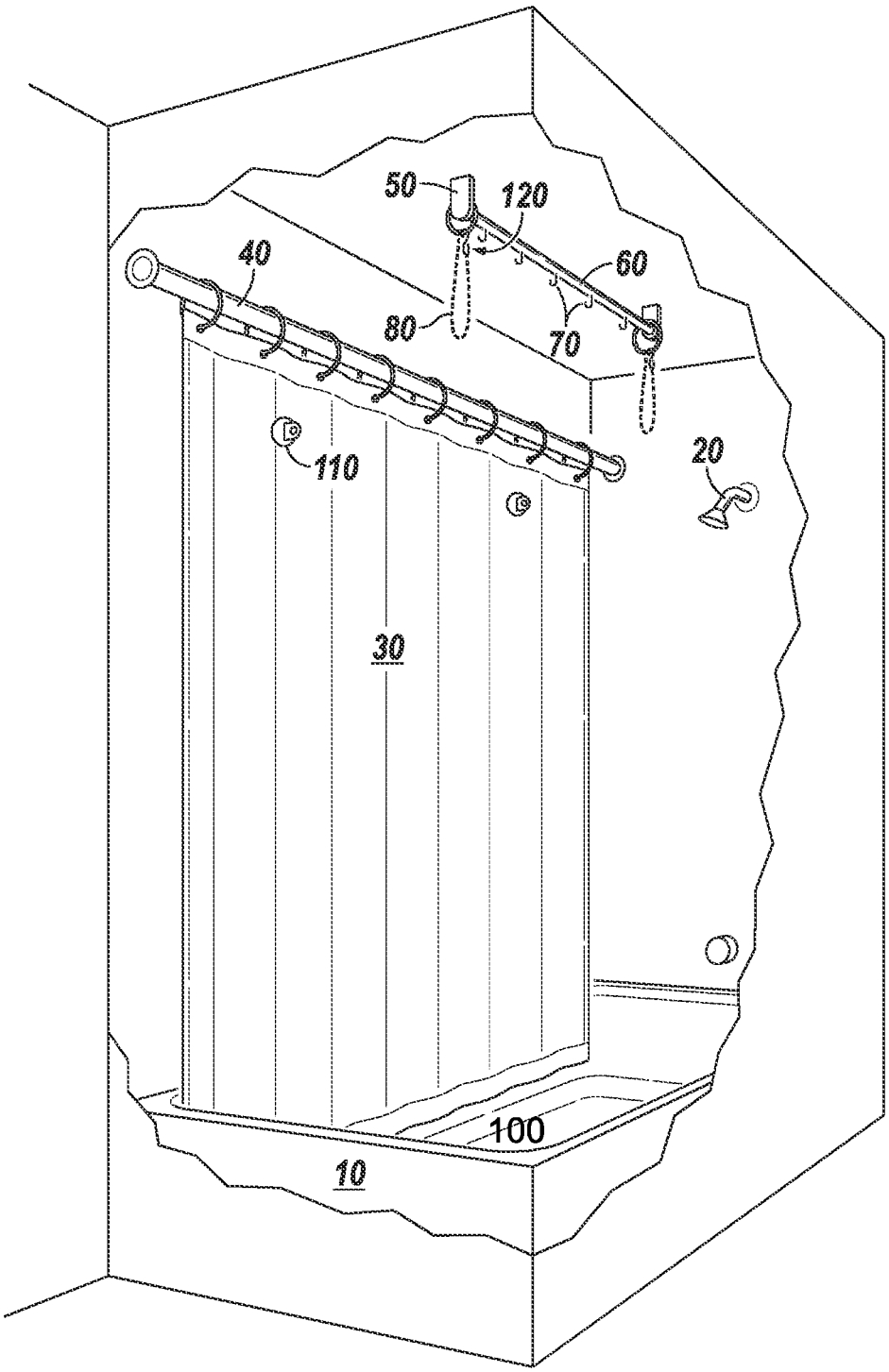
FIG. 1 is an illustration of the invention from inside of the shower and tub wherein the device is not employed.

10 tub wall
20 shower head
30 curtain
40 curtain rod
50 anchors
60 anchor to anchor connection
70 hooks
80 curtain retainers
100 tub
110 reciprocal shower curtain connection
120 s hook

DETAILED DESCRIPTION

Introduction

We intend that particulars we show herein are by way of example and for purposes of illustrative discussion of the preferred embodiments of the present invention only. We present these embodiments in the cause of providing what we believe to be the most useful and readily understood description of the principles and conceptual aspects of various embodiments of the invention. In this regard, we make no attempt to show structural details of the invention in more detail than is necessary for the fundamental understanding of the invention. We further intend that the description taken with the drawings should make apparent to those skilled in the art how the several forms of the invention can be embodied in practice.

We intend that the following definitions and explanations control any future construction unless they are clearly and unambiguously modified in the following examples or when application of the meaning renders any construction meaningless or essentially meaningless. In cases where the construction of the term would render it meaningless or essentially meaningless, the definition we intend that the definition from Webster's Dictionary 3rd Edition should be used.

Distal, in certain instances, can be defined as toward the ceiling of the shower tub. By ceiling we mean the ceiling directly above the tub of a shower and tub combination or shower stall combination as is found in a common residence, such as a typical residence within the United States of America.

Proximal, in certain instances, can be defined as toward the bottom of the shower tub.

Longitudinal, in certain instances should be defined as the long length generally found in shower tubs running from the shower head wall to the wall opposite the shower head. In situations wherein the tub has an unusual shower head configuration, we mean that longitudinal should be from the two longest walls of the shower tub.

Latitudinal, in certain instances should be defined as the width of the shower tub, running from the wall which is the shortest distance opposite the inner tub wall and the shower curtain. In most embodiments, such as standard tub showers, latitudinal is perpendicular to longitudinal. In most embodiments, the boundaries of the latitudinal direction is a wall running longitudinal and a tub wall or curtain facing the wall running longitudinal.

Tub is defined as the proximal most wall of the shower tub designed to hold water or capable of holding water and containing a wall rising distally from the proximal most wall. In certain embodiments the tub is defined as the proximal most wall of the shower tub which, if the shower drain is blocked, can hold water up to the wall rising distally from the proximal most wall.

The tub wall is defined as the wall rising distally from the proximal most wall. In certain embodiments, the tub wall is a standard type tub wall seen in most bathrooms which retains water for bathing. In other embodiments, the tub wall is a lip which can block some water from exiting from the tub and onto the bathroom floor. In this alternative embodiment, the tub is part of a shower stall that does not possess a true bathtub in the ordinary meaning, but a lip to keep shower water in the stall and away from the bathroom floor.

The shower curtain is defined as the flexible plastic, cloth, or polymer based sheet which is opposite the wall running longitudinal.

Curtain rod is defined as a rod running longitudinal and parallel to the wall running longitudinal. In certain embodiments, the curtain rod is distal to the curtain. In most embodiments, the curtain rod runs from the shower head wall to the wall opposite the shower head. In embodiments of the invention, the shower curtain is directly attached to the curtain rod or functionally attached to the curtain rod via curtain rod holders. Curtain rod holders are loops or hooks which hold the distal end of the curtain to the curtain rod.

Tub to curtain contact is defined as the proximal portion of the shower curtain contacting the inner side of the tub wall, which faces the wall running longitudinal.

Curtain to wall contact is defined as the longitudinal ends of the curtain which are perpendicular to the proximal end and distal end of the curtain and which can contact the shower head wall or the wall opposite the shower head.

Curtain to curtain contact is defined as folds of the curtain which, when wet or dry, contact other folds in the curtain.

Embodiments of the invention disclosed herein pertain to a device and method of drying a shower curtain such that there is no curtain to tub wall contact, no curtain to curtain contact and no curtain to wall contact. In such embodiments, the method and device disclosed herein prevents the growth of mold, mildew, bacteria, mineral deposits and the like.

In certain embodiments of the invention an anchored ceiling attachment is contemplated. In this embodiment, the anchored ceiling attachment is attached to the ceiling directly above the tub. In most embodiments, the anchored ceiling attachment comprises a plurality of anchor points. In certain embodiments, the anchored ceiling attachment comprises two anchor points, three anchor points, four anchor points or more anchor points. The anchored ceiling attachment is positioned generally longitudinal and parallel to the curtain. The anchored ceiling attachment is proximal to the ceiling. In most embodiments, the anchored ceiling attachment is proximal to the ceiling but no more than parallel with the height of the curtain rod. In certain other embodiments, the anchored ceiling attachment is half the distance between the curtain rod and the ceiling.

In further embodiments regarding the anchored ceiling attachment, the anchored ceiling attachment comprises a plurality of anchors which attach the anchored ceiling attachment to the ceiling itself. In certain embodiments the anchor points are an adhesive. In certain other embodiments, the anchor points are a screw, such as an eye screw or a hook screw. In certain other embodiments, the anchor point is a device screwed into the ceiling with an attachment point and a corresponding attachment point on the anchored ceiling device. An example of this in a typical bathroom setting is a towel holder attached to a wall. In certain other embodiments, the anchor point is a molded tile that is within a tiled ceiling. In certain other embodiments the anchored ceiling attachment is another curtain type rod that traverses the ceiling longitudinal and abuts the wall with the shower head and the wall opposite the wall with the shower head.

In certain other embodiments concerning the anchored ceiling attachment, there exists an anchor to anchor connection. In such embodiments, the anchor to anchor connection is a chain. In certain other embodiments the anchor to anchor connection is a rope. In certain other embodiments, the anchor to anchor connection is a string of lights which are resistant to contact with water. In certain other embodiments, the anchor to anchor connection is a wire. In certain other embodiments, the anchor to anchor connection is a rod analogous to a substantially straight towel rod. In all such embodiments, the anchor to anchor connection is a material which is resistant to damage by water. In all such embodiments, the resistance includes a reduction in mold growth, mildew growth, bacterial growth or some combination thereof. The resistance, preferably, should be less than that of a wet shower curtain making tub to curtain contact.

In certain other embodiments concerning the anchor to anchor connection. The connection comprises hooks, clips or other attachment devices hanging in a proximal direction from the anchor to anchor connection. In certain embodiments the attachment devices are s hooks. In certain embodiments, the attachment devices are clamps. In certain embodiments, the attachment devices are clothesline clamps. In certain other embodiments, the attachment devices are loops. The attachment devices are contemplated to secure bathing or showering tools to the anchor to anchor connection. Examples of bathing or showering tools include, but are not limited to loofa sponges, soft sponges and washcloths.

In certain other embodiments concerning the anchor to anchor connection, the connection further comprises a curtain retainer. In such embodiments, the curtain retainer is a chain. In certain other embodiments the curtain retainer is a rope. In certain other embodiments, the curtain retainer is a string of lights which are resistant to contact with water. In certain other embodiments, the curtain retainer is a wire. One end of the curtain retainer is connected to the anchor to anchor connection or an anchored ceiling attachment. The other end of the curtain retainer is capable of being connected to the shower curtain. The curtain retainer end which interacts with the curtain can be an s hook, a tie down, a snap, a ring, a button, a button snap or a clamp. The shower curtain may comprise any reciprocal design to allow for attachment, such as a grommet, an s hook when the curtain retainer has a ring, a female or male snap when the curtain retainer has the opposite end of the snap. In certain other embodiments, the shower curtain comprises a loop through which a button can be attached, an s hook can be attached, a tie down can be attached or a clamp can be attached. In other embodiments, wherein a clamp is used, the shower curtain may have no reciprocal attachment such that the clamp simply clamps to the shower curtain. In certain embodiments, the shower curtain is modified by piercing the shower curtain or otherwise modifying the shower curtain such that a grommet can be used, a button snap can be used, a snap can be used, a ring can be used, an s hook can be used or any other item which is reciprocal to the end of the curtain retainer which connects with the shower curtain.

In further embodiments concerning the curtain retainer, the curtain retainer is the same length as or less than the distance from the anchors to the curtain rod. In such embodiments concerning the shower curtain retainer, generally a plurality of curtain retainers is employed. The each of the plurality of curtain retainers is placed longitudinal to one another. In certain embodiments the end of the curtain retainer opposite the shower curtain is attached to the anchor, the anchor to anchor connection or a combination thereof. In embodiments wherein the curtain retainers are placed longitudinal to one another, any space length can be employed as long as it is less than the length of the wall having the shower head and the opposite wall and is amenable to the shower curtain not touching other folds of the shower curtain or said walls when the curtain is retained. In such embodiments, the curtain retainers, as a non-limiting example, can be spaced between 1 inch and 70 inches or any distance therein.

The opposite ends of the curtain retainer, those which do not interact with the curtain, can be attached to the anchor or anchor to anchor connection by any number of methods. These methods include but are not limited to gluing, linking a curtain retainer chain link to the anchor to anchor connection, welding, tying, using a clamp and the like.

When the curtain is retained by curtain retainers, the curtain is pulled back toward the back wall of the shower such that no sides of the curtain are touching a shower wall, the tub or the tub wall. Preferably, the curtain retainers will contact the curtain such that no part of the curtain touches any other part of the curtain. Accordingly, a person of ordinary skill in the art will understand that curtain retainer spacing can changed in certain embodiments of the invention to prevent folds in the shower curtain itself.

When the curtain is not being retained by curtain retainers, the curtain retainers are attached to the anchor connection or the anchor to anchor connection, whichever is preferable in the embodiment chosen. Alternatively, in certain embodiments, wherein the curtain retainers are retractable, as in the case of a device similar to a retractable tape measure, the curtain retainers retract into the retractable device.

When the curtain is not being retained by the curtain retainer, the ends of the curtain retainers which are able to attach to the shower curtain are instead attached to the anchors or to the anchor to anchor connection(s), whichever the case may be. In typical embodiments, such as wherein the anchor to anchor connection is a chain and the end of the curtain retainer possesses a s hook. The curtain retainer can be hooked to the chain anchor to anchor connection. In other embodiments, the curtain retainer can be fastened to the anchor or to the anchor to anchor connection through the use of a reciprocal connection on the anchor or anchor to anchor connection. In still other embodiments, the curtain retainers can be draped over the anchor to anchor connection and then pulled down and reconnected to the shower curtain when the shower curtain needs to be dried without the growth of mold, mildew, bacteria and the like. In other embodiments, the curtain retainers are retracted in a manner similar to that of a tape measure, with a corresponding retraction device mounted on the anchors or the anchor to anchor connection.

Implementation

The following illustrative embodiments are included to demonstrate certain embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit or scope of the invention. The following Examples are offered by way of illustration and not by way of limitation.

Figure 2:
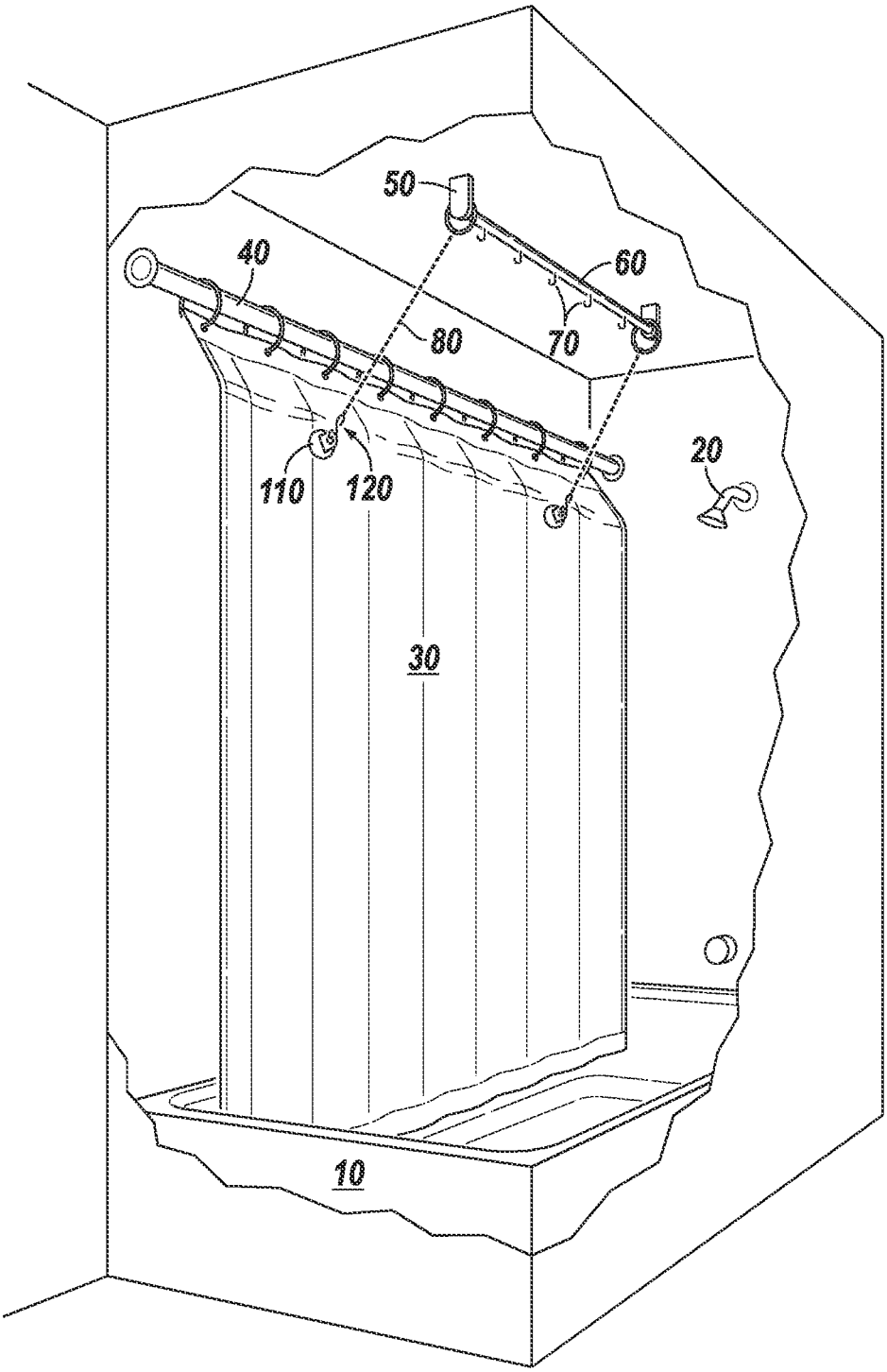
FIG. 2 is an illustration of the invention from inside the shower and tub wherein the device is retaining the curtain.

As can be seen, FIGS. 1 and 2 are an illustrations of the invention from outside of the shower and tub such that the tub wall 10 is visible as well as the shower head 20. In this illustration the curtain 30 is supported by the curtain rod 40. The invention illustrates the anchors 50 positioned distal to the curtain rod 40 and the anchor to anchor connection 60. Further, on the anchor to anchor connection, there are hooks 70 to allow for hanging bathing and showering implements such as washcloths and sponges. Although the anchor to anchor connection 60 in this figure is a rod, we envision that other anchor to anchor connections can be used such as a chain. In other embodiments, the anchor to anchor connection 60 can be a rope; string of lights; or wire. At both ends of the anchor to anchor connection 60 are curtain retainers 80 which are not in use in FIG. 1. Accordingly, they are depicted as being hooked to the anchor to anchor connection 60.

In FIG. 2, the tub wall 10 can be seen encircling the tub 100. As can be further seen, the curtain rod 40 is supporting the shower curtain 30. However, in this illustration, the curtain retainers 80 are extended and are pulling back the curtain 30 so that the curtain does not touch a wall of the shower stall, the tub 100 or the tub wall 10. In another embodiment, the curtain retainers 80 can be a rope; string of lights; or wire. This allows the curtain to dry without moist contact and thereby prevents the growth of mold, mildew, bacteria and the like.

As can be further seen in FIGS. 1 and 2, the anchors 50 are seen at the ceiling of the shower. Proximal to the anchors is the anchor to anchor connection 60.

As can be seen in FIGS. 1 and 2, the reciprocal shower curtain connection 110 can be a button hook that is capable of receiving an s hook 120 at the end of the curtain retainer 80. In other embodiments, the reciprocal shower curtain connection 110 can be a snap and reciprocal snap; clip; or magnet. In this particular embodiment, the curtain retainer is composed of a chain. However, the curtain retainer could be of other compositions as described above.

From the foregoing description, one of ordinary skill in the art can easily ascertain the essential characteristics of this disclosure, and without departing from the spirit and scope thereof, can make various changes and modifications to adapt the disclosure to various usages and conditions. For example, we do not mean for references such as above, below, left, right, and the like to be limiting but rather as a guide for orientation of the referenced element to another element. A person of skill in the art should understand that certain of the above-described structures, functions, and operations of the above-described embodiments are not necessary to practice the present disclosure and are included in the description simply for completeness of an exemplary embodiment or embodiments. In addition, a person of skill in the art should understand that specific structures, functions, and operations set forth in the above-described referenced patents and publications can be practiced in conjunction with the present disclosure, but they are not essential to its practice.

The invention can be embodied in other specific forms without departing from its spirit or essential characteristics. A person of skill in the art should consider the described embodiments in all respects only as illustrative and not restrictive. The scope of the invention is, therefore, indicated by the appended claims rather than by the foregoing description. A person of skill in the art should embrace, within their scope, all changes to the claims which come within the meaning and range of equivalency of the claims.

I claim:

1. A shower curtain drying device in a shower having a tub wall comprising:

a) a plurality of anchors in a ceiling of the shower, the plurality of anchors positioned in a substantially longitudinal position and facing in a proximal direction;

b) at least one anchor to anchor connection, the connection having two ends, positioned near to the ceiling and with one end connecting to one anchor and another end connecting to another anchor, the anchor to anchor connection being further positioned between a curtain rod and a back wall of the shower;

c) a plurality of curtain retainers operationally connecting the plurality of anchors to a shower curtain when attached to the shower curtain, the shower curtain being positioned in the shower by the curtain rod; and wherein when the plurality of curtain retainers are attached to the shower curtain, the shower curtain is pulled back from the tub wall so that no part of the shower curtain touches the tub wall.

2. The device of claim 1, wherein the at least one anchor to anchor connection comprises a chain.

3. The device of claim 1, wherein the plurality of curtain retainers comprises chains.

4. The device of claim 1, wherein the plurality of anchors are eye screws.

5. The device of claim 1, wherein the at least one anchor to anchor connection further comprises hooks between the two ends of the anchor to anchor connection, wherein the hooks are able to hang a washcloth.

6. The device of claim 1, wherein when the plurality of curtain retainers are attached to the shower curtain, the shower curtain does not contact any wall of the shower.

7. The device of claim 1, wherein when the plurality of curtain retainers are attached to the shower curtain, no part of the shower curtain touches another part of the shower curtain.

8. The device of claim 1, wherein each of the plurality of curtain retainers comprises a hook which attaches to a loop on the shower curtain to retain the shower curtain.

9. The device of claim 1, wherein each of the plurality of curtain retainers comprises a snap which snaps to a reciprocal snap on the shower curtain to retain the shower curtain.

10. The device of claim 1, wherein each of the plurality of curtain retainers comprises a clip which clips to locations on the shower curtain to retain the shower curtain.

11. The device of claim 1, wherein each of the plurality of curtain retainers comprises a magnet which intersects with another magnet, a piece of metal capable of attracting a magnet, or combination thereof on the shower curtain in order to retain the shower curtain.

12. The device of claim 1, wherein when each of the plurality of curtain retainers is not retaining the shower curtain, the shower curtain is capable of contacting the tub wall.

13. The device of claim 1, wherein the at least one anchor to anchor connection comprises a rod, a wire, a rope, a string of lights, or a combination thereof.

14. The device of claim 13, wherein the at least one anchor to anchor connection comprises a rod.

15. The device of claim 1, wherein the plurality of curtain retainers comprises a chain, a rope, a wire, a string of lights, movable rods, or a combination thereof.

16. The device of claim 1, wherein the plurality of curtain retainers are made of stainless steel, galvanized steel, brass, copper, or a combination thereof.

17. The device of claim 1, wherein the at least one anchor to anchor connection is made of stainless steel, galvanized steel, brass, copper, or a combination thereof.

18. The device of claim 1, wherein the at least one anchor to anchor connection is made of plastic, cloth, or a combination thereof.

* * * * *